US007057571B2

(12) United States Patent
Courtney et al.

(10) Patent No.: US 7,057,571 B2
(45) Date of Patent: Jun. 6, 2006

(54) SPLIT WAVEGUIDE ANTENNA

(75) Inventors: Clifton C. Courtney, Cedar Crest, NM (US); Donald E. Voss, Albuquerque, NM (US)

(73) Assignee: Voss Scientific, LLC, Albuquerque, NM (US)

( * ) Notice: Subject to any disclaimer, the term of this patent is extended or adjusted under 35 U.S.C. 154(b) by 0 days.

(21) Appl. No.: 11/136,675

(22) Filed: May 24, 2005

(65) Prior Publication Data

US 2006/0012537 A1 Jan. 19, 2006

Related U.S. Application Data

(60) Provisional application No. 60/575,012, filed on May 27, 2004.

(51) Int. Cl.
*H01Q 13/00* (2006.01)

(52) U.S. Cl. ..... 343/772; 343/776

(58) Field of Classification Search ..... 343/772, 343/776, 786

See application file for complete search history.

(56) References Cited

U.S. PATENT DOCUMENTS 3,277,489 A * 10/1966 Blaisdell ..... 343/777
3,955,202 A * 5/1976 Young ..... 343/756
4,916,458 A * 4/1990 Goto ..... 343/771
5,017,936 A * 5/1991 Massey ..... 343/773
5,323,169 A 6/1994 Koslover
5,461,394 A * 10/1995 Weber ..... 343/786
6,211,837 B1 4/2001 Crouch et al.
6,559,807 B1 5/2003 Koslover
6,661,390 B1 * 12/2003 Gau et al. ..... 343/786

OTHER PUBLICATIONS

C.E. Baum, "Some Features of Waveguide/Horn Design," Sensor and Simulation Note 314, Mar. 22, 1989.
C.E. Baum, "High-Power Scanning Waveguide Array," Sensor and Simulation Note 459, Dec. 18, 2001.

* cited by examiner

*Primary Examiner*—Tho Phan
(74) *Attorney, Agent, or Firm*—Dennis F. Armijo

(57) ABSTRACT

An antenna concept for radiating intense, high power electromagnetic fields in the RF regime without electrical breakdown. The invention accomplishes this with high aperture and power efficiency, high gain, and in a geometry that is compact and conformal to a planar or curved surface. The antenna concept is compatible with standard rectangular waveguide feeds, or other hybrid transmission line geometries.

16 Claims, 7 Drawing Sheets

SPLIT WAVEGUIDE ANTENNA

CROSS-REFERENCE TO RELATED APPLICATIONS

This application is based on U.S. Provisional Application Ser. No. 60/575,012 entitled "Split Waveguide Antenna—a conformal, high efficiency, high-gain antenna for high power applications." filed on May 27, 2004, the teachings of which are incorporated herein by reference.

GOVERNMENT RIGHTS

The invention was made with Government support under F29601-03-M-0101 awarded by Department of the Air Force. The Government has certain rights in the invention.

BACKGROUND OF THE INVENTION

1. Field of the Invention (Technical Field)

This invention pertains to the field of microwave or radio frequency technology. More particularly, the invention pertains to a unique antenna called the split waveguide antenna that permits the radiation of high peak power electromagnetic fields at radio frequencies.

2. Background Art

Antennas are transducers that convert guided electromagnetic energy to radiated energy; they send out electromagnetic energy such that it is transmitted and spreads into a surrounding medium such as the atmosphere. Antennas were first intentionally employed by Heinrich Hertz in 1885 to demonstrate the transmission and radiation of electromagnetic energy across large distances. Since that time antennas have been designed for many specialized purposes, including communications, RADAR, directed energy (for military and medical purposes), and others too numerous to list or enumerate. For applications that involve low radiated RF power levels electrically small (in terms of the wavelength of the operating frequency) antennas can be used. However, it is difficult to radiate high powers (where electrical breakdown phenomena are observed) from electrically small antennas. This is because the energy density becomes large enough to cause either field emission from surfaces within the confines of or on the antenna, or breakdown in the medium surrounding the antenna, or both phenomena. Disclosed is a unique way to radiate high power electromagnetic fields from a compact and conformal antenna. By compact and conformal, it is meant, an antenna that can be deployed on or aboard weight and/or volume sensitive platforms, such as on or aboard the external stores of manned fighter aircraft such as an F-16 or F-15, or aboard an unmanned aerial vehicle such as the X-45.

There are several prior art devices that attempt to solve the problem of radiating high power from electrically small antennas. However, the shortcomings of each of the attempted solutions, is evident. U.S. Pat. No. 6,559,807 to Koslover describes a technique for realizing a high-power microwave device that includes an antenna. The antenna consists of a feed horn and two reflecting surfaces. The excitation of the radiating antenna is made through a single feed horn, and thus its power rating or capability is limited by the power capacity of the feed horn. Furthermore, the invention describes the use of multiple reflecting surfaces that are each many wavelengths in cross section. They claim that this high-power microwave device and antenna are suitable for fixed winged aircraft such as the Boeing 747 and DC-10. It is clearly not suitable for small air platforms.

U.S. Pat. No. 6,211,837 to Crouch, et al., discloses an antenna system and technique for radiating intense electromagnetic fields at L-band frequencies. The geometry of the system comprises a circular waveguide transmission line feed, conical horn transition section, and circular radiating aperture with inner and outer windows. The circular waveguide transmission line supplies and propagates the electromagnetic energy in the TM01 mode. The electromagnetic field is subsequently transported to the radiating aperture of the antenna by the conical horn section and has a TM01-like field distribution. It is well known that an antenna aperture with the TM01-like field distribution will result in a low gain radiation pattern. An actual antenna, based on the concepts described in this patent, was built to operate at L-band to radiate RF field with peak power levels of approximately 1 GW (RMS). It is known that the resulting antenna failed to radiate this level of RF power without breakdown.

Recently, Koslover, U.S. Pat. No. 5,323,169, and Baum, C. E. Baum, "Some Features of Waveguide/Horn Design," Sensor and Simulation Note 314, 22 Mar. 1989, have described methods to partition parallel plate and rectangular waveguide transmission lines carrying intense electromagnetic fields in a manner that preserves the propagating mode, minimizes or eliminates reflections and does not result in electrical breakdown.

Recently, Baum, C. E. Baum, "High-Power Scanning Waveguide Array," Sensor and Simulation Note 459, 18 Dec. 2001, described the partition of a rectangular aperture into sub-apertures for purposes of increasing the power capacity and mechanical strength of an aperture.

None of these devices; however, disclose or teach the use of an antenna that is concurrently high-power capable, compact and conformal, scalable to arbitrary power levels, and produces a high gain radiated pattern with high aperture efficiency.

SUMMARY OF THE INVENTION (DISCLOSURE OF THE INVENTION)

The present split waveguide antenna invention relates to a method and apparatus to radiate extremely high power radio frequency (RF) fields in a directive and efficient fashion from a compact (with respect to the wavelength of the operation frequency of the RF fields) and conformal with respect to a platform that carries or houses the structure. In this context, high power and intense refers to electromagnetic fields with peak powers of approximately 100 s to 1000 s of MW (root mean square); however, the split waveguide antenna concept maintains its positive attributes at any lesser power levels. This invention permits the dispersion of intense electromagnetic fields from an antenna with a volume that normally would not permit such operation due to electric field breakdown either in the antenna structure itself or in the surrounding ambient environment. Furthermore, the invention exhibits high aperture efficiency and operates in such a manner as to generate a highly directive radiated antenna pattern. In addition, the invention is scalable in its longitudinal and transverse dimensions to allow radiation of higher power levels. Finally, the invention operates in a highly efficient manner such that the ratio of radiated RF power to antenna incident power is close to 1. The invention applies to a broad range of low and high power RF applications that require compact radiating structures, including, but not limited to military directed energy, spacecraft, and terrestrial and extra-terrestrial radiated RF applications.

A primary object of the present invention is to provide a capability to divide the microwave/RF power generated by a High Power Microwave (HPM) source into multiple, lower power manageable quantities for purposes of increasing the overall power capacity of an antenna.

A second object of the present invention is to provide a capability to directively radiate high power microwave/RF fields from a compact antenna.

A third object of the present invention is to provide a capability to directively radiate high power microwave/RF fields from an antenna that is conformal to an airborne or other weight or volume sensitive platform.

A fourth object of the present invention is to provide an antenna that is physically and electrically compatible with many high power microwave sources, mating directly in a physical sense with the source's output waveguide, and in an electrical sense with the $TE_{10}$ rectangular waveguide mode.

A primary advantage of the present invention is that it divides the power from the source evenly and into manageable quantities, and distributes the power uniformly to multiple radiating apertures—maximizing power capacity.

A second advantage of the present invention is that it is inherently high-power capable, owing to a large physical radiating aperture.

A third advantage of the present invention is that it is platform compatible, envisioned for use on an air vehicle or munitions-based platform.

A fourth advantage of the present invention is that it operates in a traveling wave mode, thus minimizing the required antenna fill time.

A fifth advantage of the present invention is that it exhibits a high aperture efficiency, and will radiate a highly directive beam.

A sixth advantage of the present invention is that it is compatible with many high power microwave sources, mating directly in a physical sense with the source's output waveguide, and in an electrical sense with the rectangular waveguide $TE_{10}$ mode.

A seventh advantage of the present invention is that it exhibits capability to taper the power intensity over the aperture using either non-uniform divisions of the incident power or non-equal radiation gains for the multiple apertures.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1A:
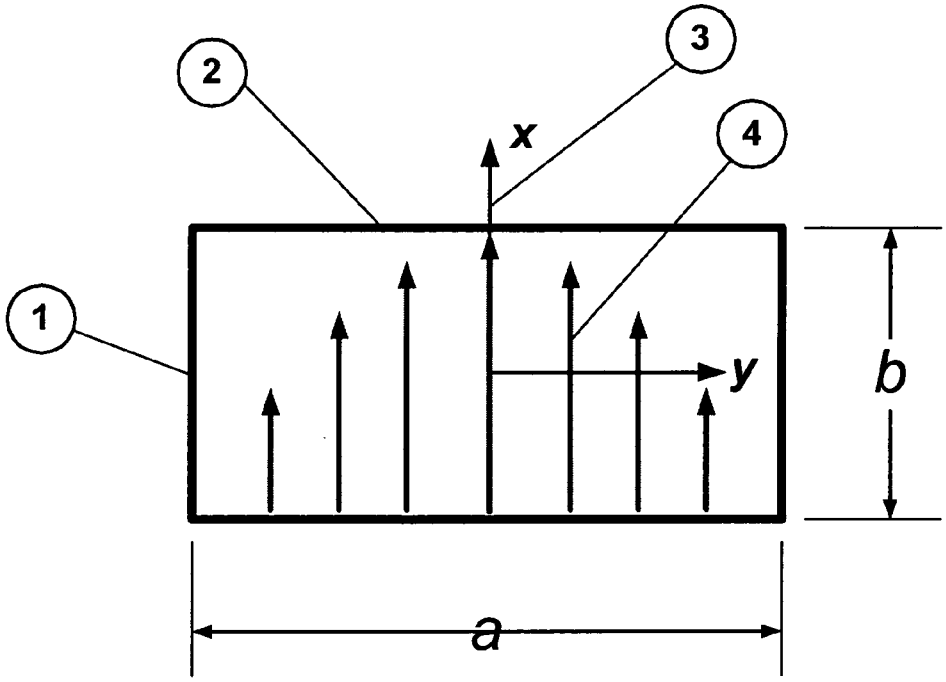
FIG. 1*a* depicts the cross section of the geometry of the rectangular waveguide feed of the split waveguide antenna in the xy-plane.
Figure 1B:
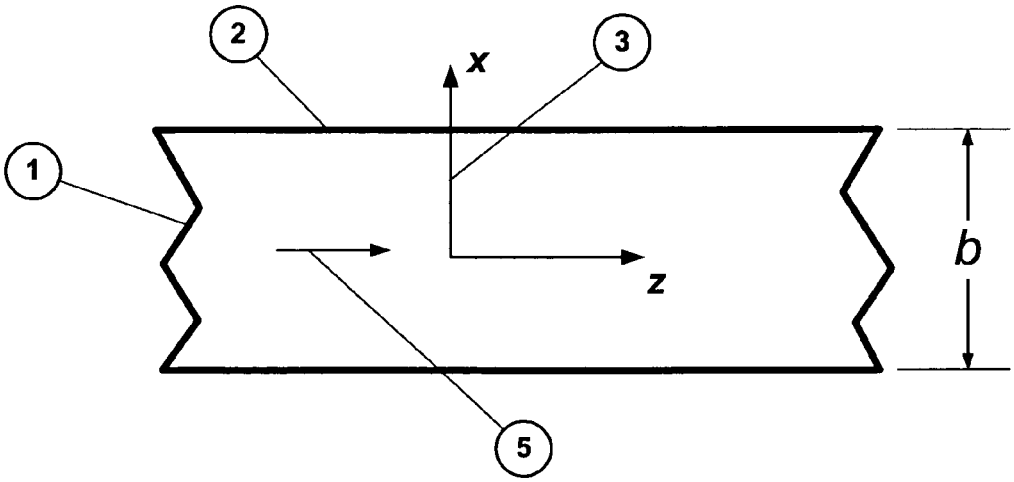
FIG. 1*b* depicts the cross section of the geometry of the rectangular waveguide feed of the split waveguide antenna of FIG. 1*a* in the xz-plane.
Figure 1C:
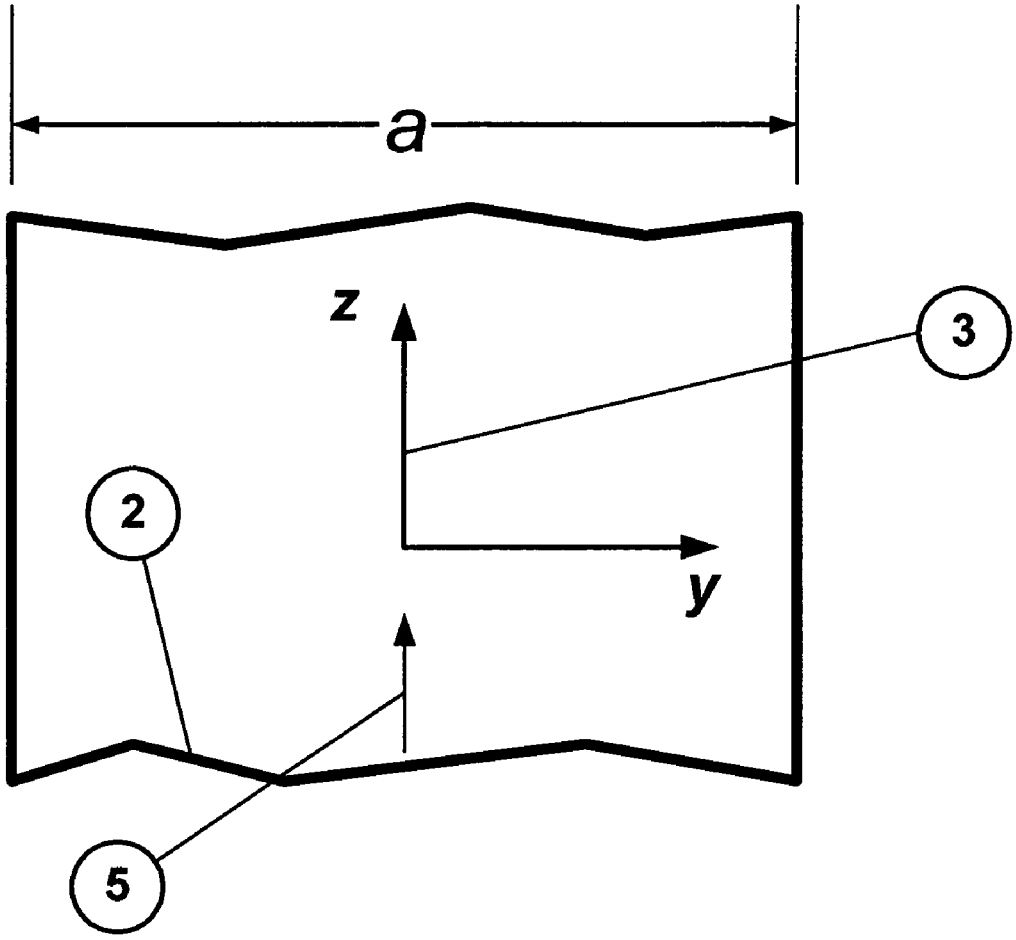
FIG. 1*c* depicts the cross section of the geometry of the rectangular waveguide feed of the split waveguide antenna of FIG. 1*a* in the yz-plane.

The geometry of a rectangular waveguide is shown in the principal plane cross sections in FIGS. 1*a*, 1*b*, and 1*c*. FIG. 1*a* depicts the cross section of the geometry of the rectangular waveguide feed of the split waveguide antenna in the xy-plane, FIG. 1*b* depicts the cross section of the geometry of the rectangular waveguide feed of the split waveguide antenna in the yz-plane and FIG. 1*c* shows the cross section of the geometry of the rectangular waveguide feed of the split waveguide antenna in the yz-plane. Narrow wall 1 has dimension a, while broad wall 2 has dimension b, $b \geqq a$. All boundaries of the waveguide guide are preferably metal and are good electrical conductors. For this invention the rectangular waveguide can be standard (one in which the dimension of the broad wall is twice the dimension of the narrow wall) or non-standard. A standard right-hand coordinate system 3 is assigned to the geometry and is also shown in the figures. An electromagnetic wave is assumed propagating 5 along the z-axis direction. The mode of the propagating electromagnetic wave is assumed to be that of the $TE_{01}$ rectangular waveguide mode 4, also known as fundamental mode of the rectangular waveguide. The height of arrows 4 is meant to indicate the relative strength of the electric field as a function of the position along the broad dimension of the waveguide.

Figure 2A:
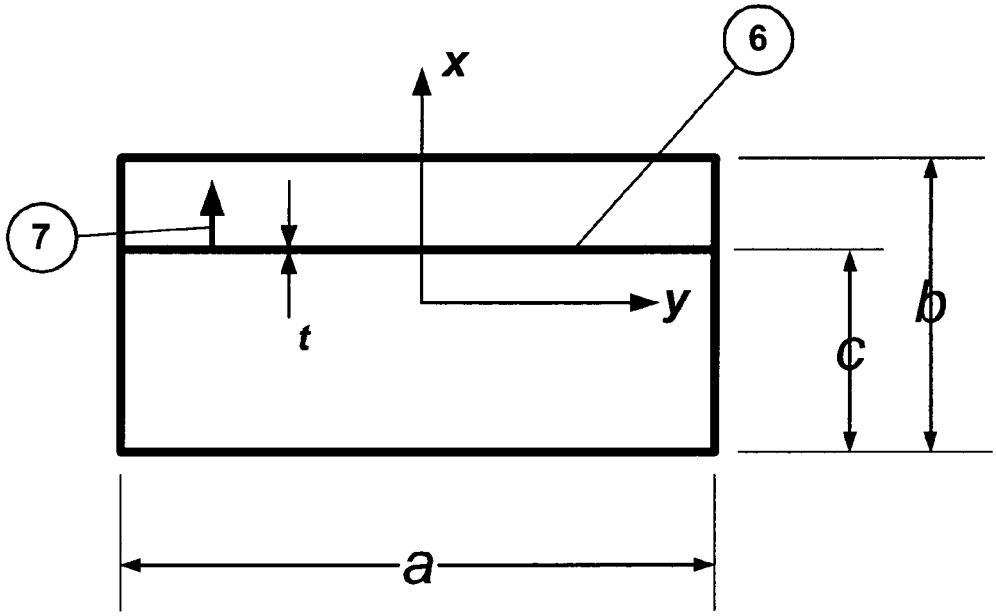
FIG. 2*a* shows the embodiment of FIG. 1 with a septum introduced into the waveguide shown in cross section.
Figure 2B:
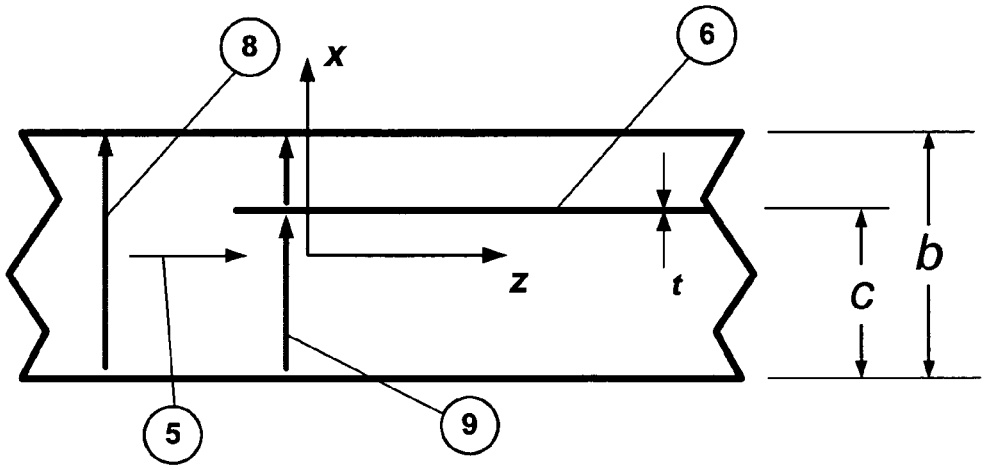
FIG. 2*b* shows the septum of FIG. 2*a* in cross section in the xz plane.

At some distance along the z-dimension of the rectangular waveguide transmission line, a septum 6 is introduced into the guide as shown in FIGS. 2*a* and 2*b*. FIG. 2*a* shows a septum, shown in cross section in the xy-plane, introduced in the rectangular waveguide for purposes of splitting the incident power among two waveguides. Septum 6, extends from one narrow wall to the other, such that it remains parallel to the broad wall of the guide. FIG. 2*b* shows that a septum 6, shown in cross section in the xz-plane, is introduced in rectangular waveguide for purposes of splitting the incident power among two waveguides. Septum 6, divides the power of the incident propagating wave in signals proportional to the heights c and b.

Septum 6 is made of a conductive metal. Septum 6 extends across the guide in a plane that is parallel to the broad wall of the rectangular waveguide. The thickness of septum 6 is denoted t, and t<<a. A vector 7 that is normal to the plane of the septum would, consequently, be parallel to the direction of the electric field in the guide. Therefore, the introduction of septum 6 does not perturb the field distribution or propagation properties of the wave. Furthermore, septum 6 effectively creates two rectangular waveguides with narrow wall dimensions c and b−c, and broad wall dimension a. Since the field distribution and propagation properties of the fundamental mode of the rectangular guide are independent of the narrow wall dimension the field propagating in the guides remains that of the $TE_{01}$ mode. It does divide the incident electromagnetic signal/power 8 into two proportional signals/powers 9 that are related by the height at which septum 6 is located in the waveguide, though the strength of the electric field associated with the two signals remains unchanged from that of the incident signal.

Figure 3A:
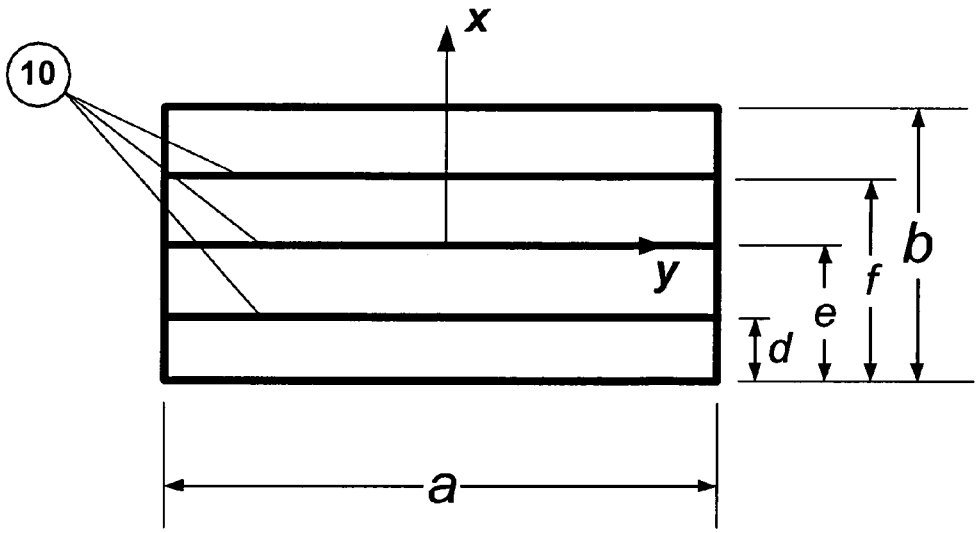
FIG. 3*a* shows an alternative embodiment with multiple septums in the xy plane.
Figure 3B:
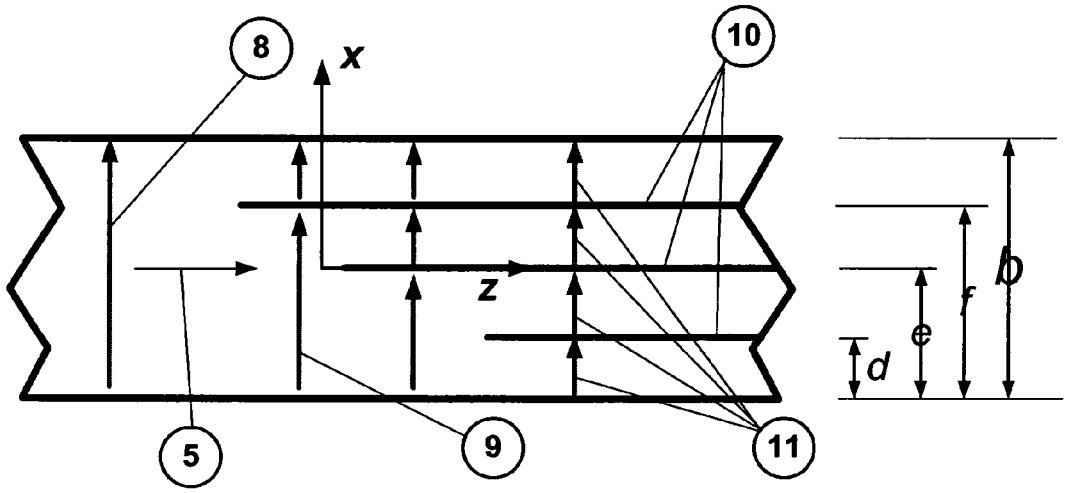
FIG. 3*b* shows the embodiment of FIG. 3*a* in the xz plane.

Depending on the split waveguide antenna design, additional and multiple septums 10 are introduced for purposes of splitting the incident power among multiple waveguides as indicated in the illustrations of FIGS. 3*a* and 3*b*. FIG. 3*a* illustrates how additional septums 10 can be placed in rectangular waveguide for purposes of splitting the incident power among multiple waveguides. All septums 10, shown in the figures in cross section in the xy-plane, extend from one narrow wall to the other such that it remains parallel to the broad wall of the guide. FIG. 3*b* illustrates how additional septums 10 can be placed in rectangular waveguide for purposes of splitting the incident power among multiple waveguides. All septums 10, shown in cross section in the xz-plane, can be introduced at various points along the axial extent of the waveguide. Septums 10 divide the power of the incident propagating wave in signals proportional to the ratios of the heights d, e and f, to b. As in the case of the single septum, as shown in FIG. 3*a* all septums 10, shown in cross section in the xy-plane, extend from one narrow wall to the other such that they remain parallel to the broad wall of the guide. It is not required that the spacing between septums 10 be equal. The strength of the incident electric field 8 is maintained in the multiple signals 11 of the resulting multiple waveguides. In general, N+1 rectangular waveguides will result from the introduction of N septums 10.

The interface between the rectangular waveguide and the split waveguide antenna is rectangular waveguide with the same geometry and dimensions as the rectangular waveguide transmission line that supplies the antenna with an electromagnetic signal. There is no requirement that the transmission line be standard rectangular waveguide or even any request for $TE_{10}$ mode. Any mode in which the electric field is exclusively in the x-direction can be split in the manner as described.

Once the power has been divided in the guide via septums 10, the electromagnetic field is guided to apertures that open through the upper broad wall of the waveguide. For N septums 10, there are realized N+1 apertures. For the sake of illustration, consider the geometry depicted in FIG. 4. There, the incident signal 8 is split into two signals 9 among two rectangular waveguides. Whereas, one of the signals 14 continues to propagate in rectangular waveguide along the axial extent of the transmission line, or z-direction, the propagation direction of the other signal 13 is transitioned into an aperture defined by structures 12. The electromagnetic field distribution in the aperture is such that efficient and directive radiation occurs. The geometries of the transition region and aperture regions are not shown, but in general they will promote low transmission line reflections and low field enhancement (to increase the power capacity of the concept).

Figure 4:
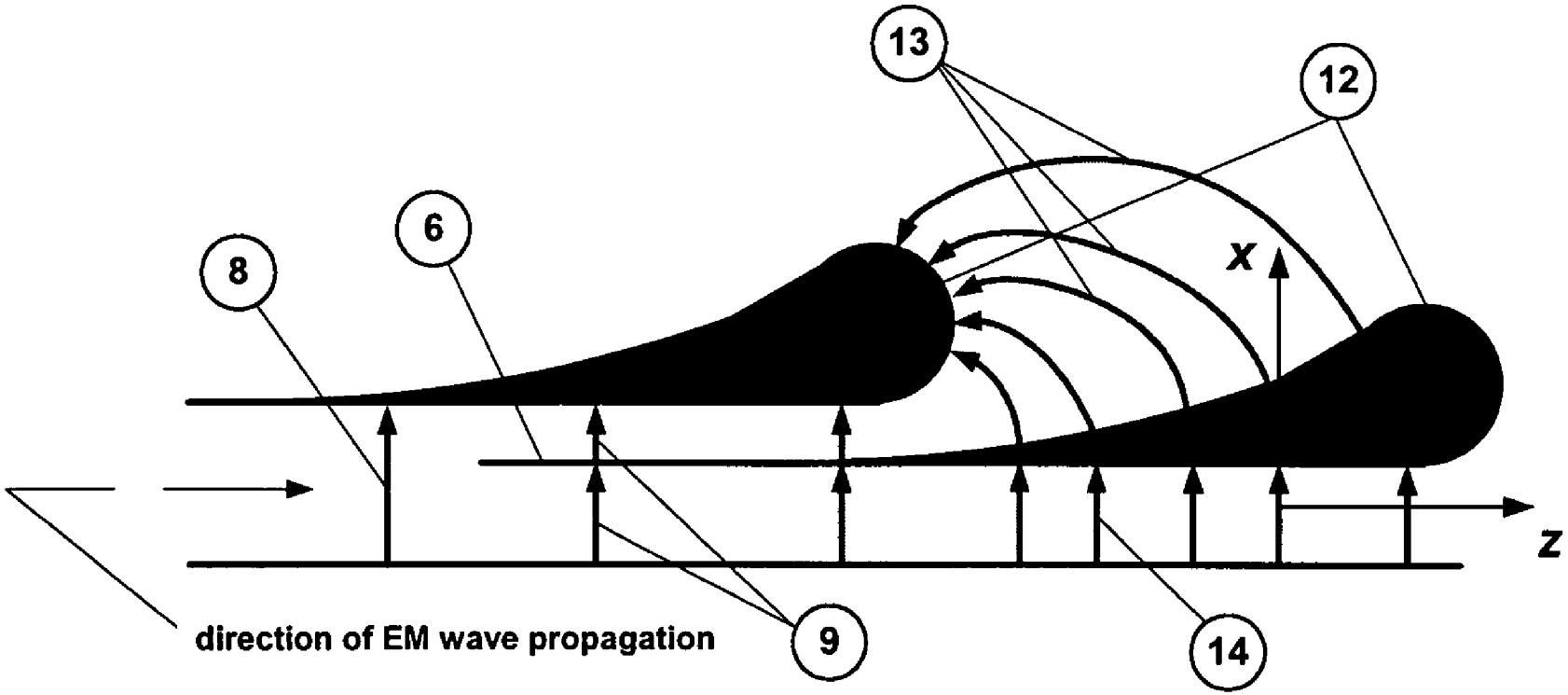
FIG. 4 shows an example of the transition of the microwave signal from a single rectangular waveguide to a single radiating aperture.
Figure 5:
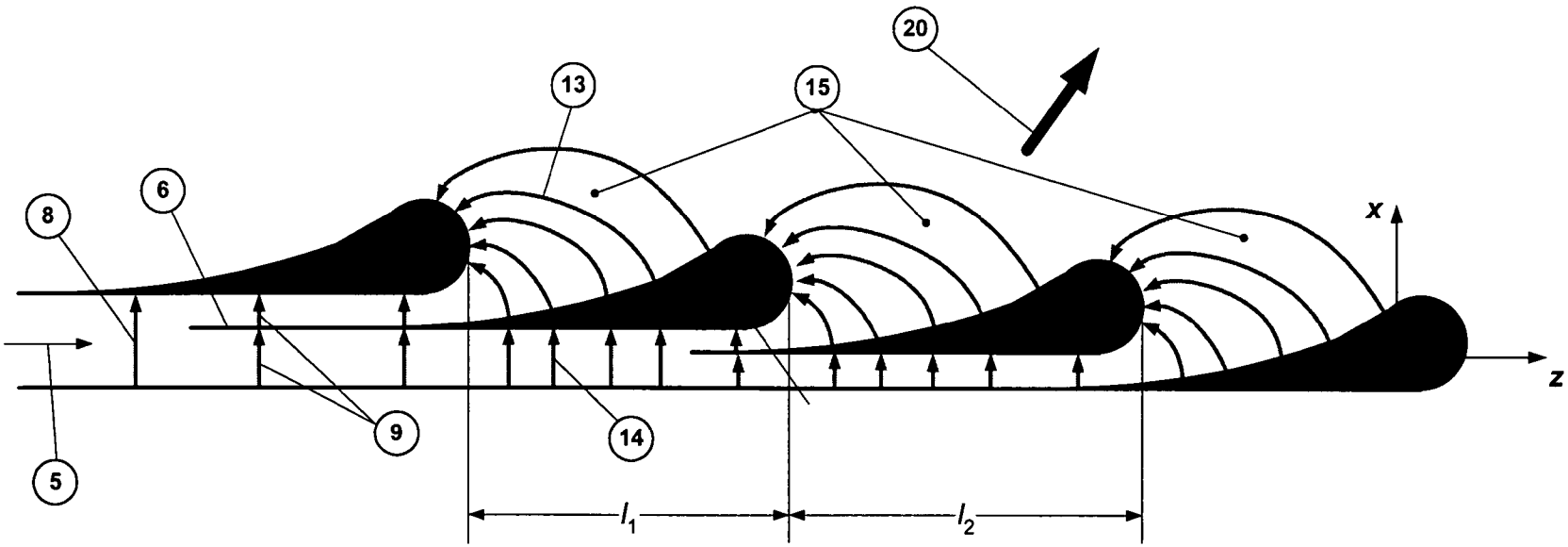
FIG. 5 illustrates how a microwave signal can be divided multiple times, and the associated electromagnetic fields of the resulting signals are transitioned to multiple radiating apertures.

Whereas FIG. 4 described the transition of the microwave signal from a single rectangular waveguide to a single radiating aperture, FIG. 5 demonstrates this technique for multiple rectangular waveguide transmission lines and radiating apertures. Incident signal 8 is first split into two signals 9. One signal 14 continues to travel along a rectangular waveguide, while the other signal 13 is transitioned to a radiating aperture. At some distance along the axial extent of the rectangular waveguide another septum is introduced. The signal 14 is divided again, with one signal continuing to travel along the axial extent of the guide and the other signal transitioning into a radiating aperture placed at some distance, indicated by $I_1$, from the previous aperture. This process repeats itself such that for N septums, there are realized N+1 radiating apertures 15. What results is an array of radiating apertures 15 that radiate a highly directive beam.

Figure 6:
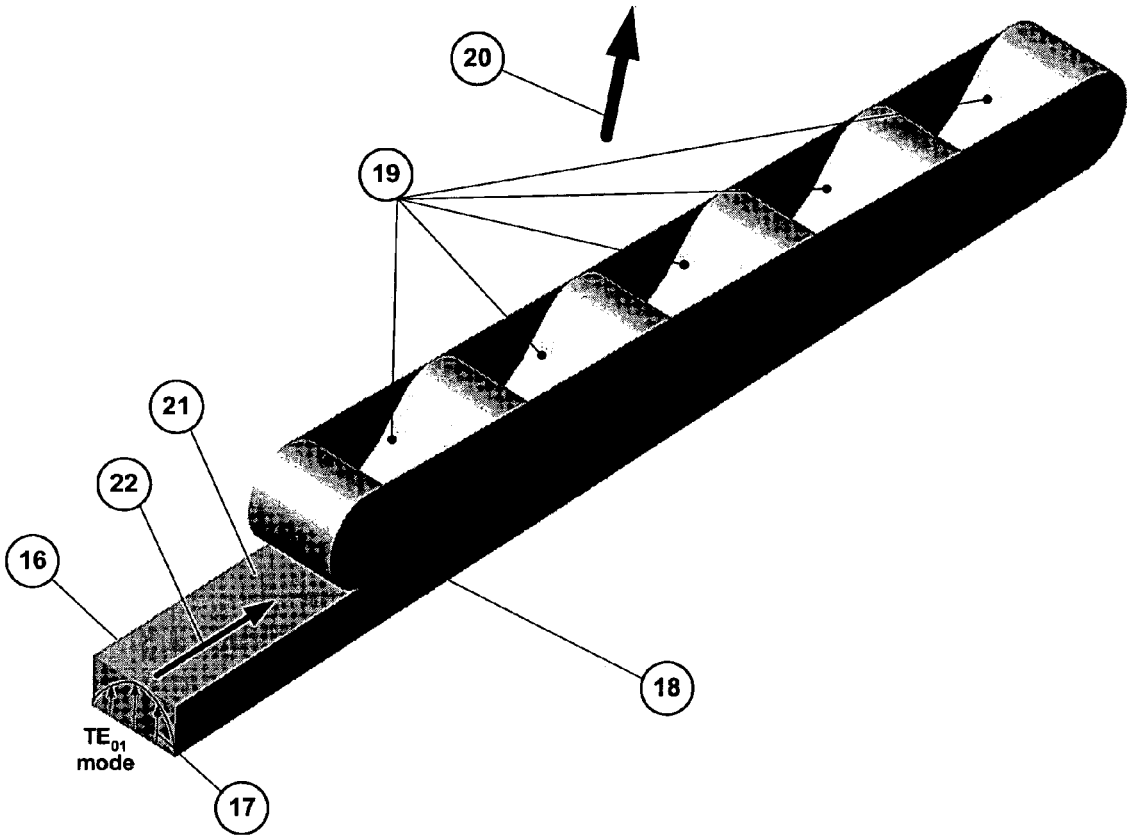
FIG. 6 is a 3-D rendering of one embodiment of the split waveguide antenna.

Finally, as an example, a 3-D rendering of one embodiment of the split waveguide antenna with four equally spaced septums is provided as FIG. 6. In FIG. 6 a single rectangular waveguide 16 is depicted propagating the $TE_{01}$ mode 17 along the axial direction 22 of the waveguide. Four septums 18 are introduced into the guide (not shown) and result in five rectangular waveguides propagating four microwave signals. These signals are transitioned to five radiating apertures 19 by structures (not shown) that alter the direction of the propagating signal. With proper spacing of the apertures, the peak of the radiated pattern will radiate in a direction 20 close to the broadside of the upper waveguide broad wall 21. A novel aspect of the present invention is the use of the waveguide broadwall. Whereas in the past antenna designers utilized a cross section in the xy-plane to radiate the RF power, this approach uses a cross section in the yz-plane. Whereas the cross section in the xy-plane is limited in size, and consequently power capacity, the present invention utilizes a radiating aperture in the yz-plane that is much larger physically. The larger aperture size gives the present invention a greater power capacity than previous waveguide-based antenna designs that utilize rectangular waveguide. The antenna's geometry, and use of the broadwall as a radiating aperture, also gives the present invention a compact and conformal character.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. An antenna for radiating a directional high power RF signal in a compact and conformal manner, the antenna comprising:

at least one first waveguide for propagating a first high power RF signal with field strength up to an electric field induced breakdown threshold of a material of the at least one first waveguide;

at least one septum for dividing the first high power RF signal into at least two second high power RF signals in at least two second waveguides;

a broadwall disposed parallel to the at least one septum;

a transitioning section passing through the broadwall for changing a direction of the at least two second RF signal's propagation from an axial direction to a perpendicular direction of the at least two second waveguides; and at least two apertures for directionally radiating the at least two second high power RF signals.

2. The antenna of claim 1 wherein a spacing of the at least two apertures comprises a peak of a radiating pattern in a predetermined direction.

3. The antenna of claim 1 wherein the at least one septum comprises multiple septums for splitting the first high power RF signal into multiple second waveguides.

4. The antenna of claim 3 wherein said multiple septums comprise unequal spacing between said multiple septums.

5. The antenna of claim 4 wherein the multiple septums are configured to non-uniformly illuminate the at least two apertures.

6. The antenna of claim 3 wherein said multiple septums comprise equal spacing between said multiple septums.

7. The antenna of claim 6 wherein the multiple septums are configured to uniformly illuminate the at least two apertures.

8. The antenna of claim 1 further comprising at least one similar second antenna for dividing and radiating the at least two second RF signals into at least two third RF signals.

9. A method of radiating a directional high power RF signal in a compact and conformal manner from an antenna, the method comprising the steps of:

a) propagating a first high power RF signal from at least one first waveguide with field strength up to an electric field induced breakdown threshold of a material of the at least one waveguide;

b) dividing the first high power RF signal into at least two second high power RF signals in at least two second waveguides with at least one septum;

c) providing a broadwall disposed parallel to the at least one septum;

d) changing a direction of the at least two second RF signal's propagation from an axial direction to a perpendicular direction of the at least two second waveguides via a transitioning section passing through the broadwall; and e) directionally radiating the at least two second high power RF signals through at least two apertures.

10. The method of claim 9 further comprising spacing the at least two apertures in a predetermined configuration to provide a peak of a radiating pattern in a predetermined direction.

11. The method of claim 9 further comprising the step of splitting the first high power RF signal into multiple second waveguides with multiple septums.

12. The method of claim 11 wherein the multiple septums comprise unequal spacing between the multiple septums.

13. The method of claim 12 wherein the step of radiating comprises non-uniformly illuminating the at least two apertures.

14. The method of claim 11 wherein the multiple septums comprise equal spacing between the multiple septums.

15. The method of claim 14 wherein the step of radiating comprises uniformly illuminating the at least two apertures.

16. The method of claim 9 further comprising the step of dividing and radiating the at least two second RF signals into at least two third RF signals.

* * * * *